US012527375B2

(12) United States Patent
Kim

(10) Patent No.: US 12,527,375 B2
(45) Date of Patent: Jan. 20, 2026

(54) WIG APPARATUS HAVING ANTI-SLIP BAND

(71) Applicant: SHAKE-N-GO FASHION, INC., Port Washington, NY (US)

(72) Inventor: Susan Kim, Manhasset, NY (US)

(73) Assignee: SHAKE-N-GO FASHION, INC., Port Washington, NY (US)

( * ) Notice: Subject to any disclaimer, the term of this patent is extended or adjusted under 35 U.S.C. 154(b) by 368 days.

(21) Appl. No.: 18/001,908

(22) PCT Filed: Jun. 15, 2021

(86) PCT No.: PCT/US2021/037370
§ 371 (c)(1),
(2) Date: Dec. 15, 2022

(87) PCT Pub. No.: WO2021/257528
PCT Pub. Date: Dec. 23, 2021

(65) Prior Publication Data

US 2023/0232924 A1 Jul. 27, 2023

Related U.S. Application Data

(60) Provisional application No. 63/039,174, filed on Jun. 15, 2020.

(51) Int. Cl.
*A41G 3/00* (2006.01)

(52) U.S. Cl.
CPC ..... *A41G 3/005* (2013.01)

(58) Field of Classification Search
CPC ..... A41G 3/005; A41G 3/0041; A41G 3/001; A41G 3/008; A41G 3/0016; A41G 3/0033; A41G 3/0058; A41G 3/0025
See application file for complete search history.

(56) References Cited

U.S. PATENT DOCUMENTS 9,027,568 B2 5/2015 Lee
10,798,981 B2 * 10/2020 Toba ..... A45D 44/22
(Continued)

FOREIGN PATENT DOCUMENTS

CH 554655 A * 10/1974 ..... A41G 3/0016
KR 101869977 B1 6/2018
WO 2021257528 A1 12/2021

OTHER PUBLICATIONS

CH 554655 A (Hair Contact AG) Toupet Oder Peruecke., Oct. 15, 1974 [retrieved on Feb. 4, 2025]. Translation retrieved from: Espacenet (Year: 1974).*
(Continued)

*Primary Examiner* — Eric J Rosen
*Assistant Examiner* — Courtney N Huynh
(74) *Attorney, Agent, or Firm* — Brian R. Volk

(57) ABSTRACT

A wig apparatus comprising: artificial hair; a mesh cap configured to cover the scalp of a user comprising an inner surface, an outer surface, and a folded portion; an elastic band configured to extend around the user's head comprising an outer elastic band surface, an inner elastic band surface, a bottom band edge and a top band edge; and a silicone strip configured to extend around a circumference of the mesh cap on the inner surface of the mesh cap comprising a top strip edge and a bottom strip edge, the silicone strip coupled to at least a portion of the elastic band.

15 Claims, 6 Drawing Sheets

(56) References Cited

U.S. PATENT DOCUMENTS

| | | | | |
|---|---|---|---|---|
| 2007/0044814 | A1 | 3/2007 | Belo | |
| 2010/0000567 | A1 | 1/2010 | Park | |
| 2011/0073122 | A1 | 3/2011 | Shigematsu | |
| 2014/0116456 | A1 | 5/2014 | Palmer-Rogers | |
| 2015/0327609 | A1 | 11/2015 | Suh | |
| 2017/0095026 | A1 | 4/2017 | Chung | |
| 2017/0265548 | A1 | 9/2017 | Tao et al. | |
| 2018/0007988 | A1 | 1/2018 | Kim et al. | |
| 2018/0014593 | A1 | 1/2018 | Suh et al. | |
| 2019/0059486 | A1* | 2/2019 | Kim | A41G 3/005 |
| 2019/0297977 | A1 | 10/2019 | Kim et al. | |
| 2020/0085125 | A1 | 3/2020 | Tokunaga et al. | |

OTHER PUBLICATIONS

"Plussign Wig Caps for Making Wigs U Part Lace Weaving Net Mesh Black Dome Cap Breathable Nylon Hair Net Wig Making Tools", https://www.aliexpress.us/item/2255799833400815.html?gatewayAdapt=glo2usa4itemAdapt, printed on Jun. 16, 2023 (5 pages).

"Freetress Lace Crochet Cap", http://www.ebonyline.com/freetress-lace-crochet-wig-cap.html, printed on Mar. 16, 2023 (4 pages).

"Shake-N-Go Crochet Oval Part Wig Cap" http://www.ebonyline.com/shake-n-go-crochet-oval-part-wig-cap.html, printed Mar. 16, 2023 (5 pages).

* cited by examiner

WIG APPARATUS HAVING ANTI-SLIP BAND

CROSS-REFERENCE TO RELATED APPLICATION

This application claims priority to U.S. Provisional Patent Application No. 63/039,174, filed on Jun. 15, 2020, and is a U.S. National Phase of PCT/US21/37370, filed on Jun. 15, 2021, the entire contents of which are incorporated herein by reference.

BACKGROUND OF THE INVENTION

Field of the Invention

The present invention relates generally to wigs, and more particularly, to a wig apparatus having an anti-slip band.

Description of the Related Art

Hair extensions and wigs are used by people to enhance their appearance. Wigs generally include multiple strands of hair attached to a cap to form a unit that can be secured to a user's scalp. Hair weaves and hair extensions are also used by people to either conceal or supplement their natural hair. In some cases, people use wigs when they are experiencing baldness or thinning of their natural hair. For those experiencing baldness or thinning of natural hair, use of wigs provides an alternative to use of potentially dangerous hair growth drugs or chemicals, or uncomfortable hair plugs. In other cases, people use wigs for temporary purposes when they are undergoing medical treatments that result in loss of their hair, such as chemotherapy.

Hair extensions and wigs are also used to provide a user with an alternative hair color in order to improve their appearance. Furthermore, hair extensions and wigs can be used by people to present an alternative texture to their own hair, such as changing their hair from straight to curly. Just as many people enjoy accessorizing their wardrobe, people who wear hair extensions and wigs enjoy changing and enhancing their appearance.

SUMMARY OF THE INVENTION

Embodiments of the invention described herein provide a wig apparatus. The wig apparatus comprises: artificial hair; a mesh cap configured to cover the scalp of a user comprising an inner surface, an outer surface, and a folded portion, wherein the artificial hair is coupled to at least a portion of the outer surface of the mesh cap; an elastic band configured to extend around the user's head comprising an outer elastic band surface, an inner elastic band surface, a bottom band edge and a top band edge, wherein the elastic band is coupled to the mesh cap and extends around a circumference of the mesh cap, and wherein the folded portion of the mesh cap wraps around at least a portion of the bottom edge of the elastic band such that at least a portion of the outer elastic band surface is in contact with the inner surface of the mesh cap and at least a portion of the inner elastic band surface is in contact with the inner surface of the mesh cap; and a silicone strip configured to extend around a circumference of the mesh cap on the inner surface of the mesh cap comprising a top strip edge and a bottom strip edge, the silicone strip coupled to at least a portion of the elastic band.

According to further embodiments: a thickness of the silicone strip is less than a thickness of the elastic band; a thickness of the silicone strip is about equal to a thickness of the elastic band; a thickness of the silicone strip is selected from one of about half, about one quarter and about three quarters of the thickness of the elastic band; the folded portion of the mesh cap extends up to the bottom strip edge of the silicone strip; the folded portion of the mesh cap extends underneath the silicone strip such that at least a portion of the folded portion is disposed between the silicone strip and the elastic band; the folded portion of the mesh cap extends underneath the silicone strip such that at least a portion of the folded portion is disposed between the silicone strip and the elastic band, and wherein at least a portion of the folded portion extends beyond the top strip edge of the silicone strip; the folded portion of the mesh cap extends underneath the silicone strip such that at least a portion of the folded portion is disposed between the silicone strip and the elastic band, and wherein at least a portion of the folded portion extends beyond the top strip edge of silicone strip and does not extend beyond the elastic band; the mesh cap is configured to have artificial hair coupled to the outer surface of the mesh cap adjacent to the outer elastic band surface and adjacent to the inner elastic band surface; the folded portion of the mesh cap is configured to have artificial hair coupled to a location where the mesh cap folds around the elastic band; the folded portion of the mesh cap does not overlap the silicone strip; the folded portion of the mesh cap is disposed between the bottom strip edge of the silicone strip and the elastic band, and wherein the folded portion of the mesh cap is not disposed between the top strip edge of the silicone strip and the elastic band; the elastic band comprises a space between the folded portion of the mesh cap and the bottom strip edge of the silicone strip; a parting region comprises an inner parting region surface and an outer parting region surface and wherein the artificial hair is coupled to the outer parting region surface and a seam is sewn along the parting region that stitches together at least a portion of each of the parting region, the mesh cap, the silicone strip and the elastic band; and the elastic band and the silicone strip extend up to the parting region and do not extend over the parting region.

BRIEF DESCRIPTION OF THE DRAWINGS

The above and other aspects, features and advantages of certain embodiments will be more apparent from the following detailed description taken in conjunction with the accompanying drawings, in which.

DETAILED DESCRIPTION OF THE PRESENT INVENTION

The following detailed description of certain embodiments will be made in reference to the accompanying drawings. In the detailed description, explanation about related functions or constructions known in the art are omitted for the sake of clearness in understanding the concept of the invention, to avoid obscuring the invention with unnecessary detail.

The phrase "artificial hair," as used herein, refers to synthetic hair products as well as human hair or animal hair and combinations thereof. The artificial hair may be embodied in various traditional hair colors, such as black, brown, blonde, and red, as well as non-traditional hair colors, such as blue, green, and purple, and combinations thereof, including individual strands of hair having two or more colors. The artificial hair may be embodied in various textures, such as curly, wavy, straight, thick, thin, and combinations thereof.

The term "user," as used herein, refers to any purchaser of the wig configured according to any of the embodiments disclosed herein, including, but not limited to, individual members of the public, wholesale distributors, retail merchants, manufacturers, importers and exporters of the wig and related components of the wig.

Reference to individual embodiments, whether by number of embodiment or relevant feature of the embodiment, is used for convenience in describing such embodiments. Moreover, reference to individual embodiments does not indicate that any of such embodiments are preferred over any other embodiments. Furthermore, each individual embodiment may be combined with any other individual embodiment whether or not expressly stated.

Embodiments of the invention described herein provide a wig apparatus that is configured to fit onto, and be secured tightly to, a user's head. The wig apparatus includes various components configured to securely couple the wig apparatus to the user's head, while also providing a desirable and fashionable appearance. As further described herein, the wig apparatus is configured such that a user is able to couple artificial hair to a mesh cap, allowing the user to customize the appearance of the wig apparatus to their own personal preference.

According to embodiments described herein, a wig apparatus includes a mesh cap, an elastic band, a silicone band and multiple combs. A portion of the mesh cap folds around the elastic band at an edge of the mesh cap. The user is able to couple artificial hair to the outer surface of the mesh cap, the perimeter of the mesh cap, as well as the inner surface of the wig apparatus. The silicone band and the combs are disposed on the inner surface of the mesh cap and secure the mesh cap to the user's head.

Figure 1:
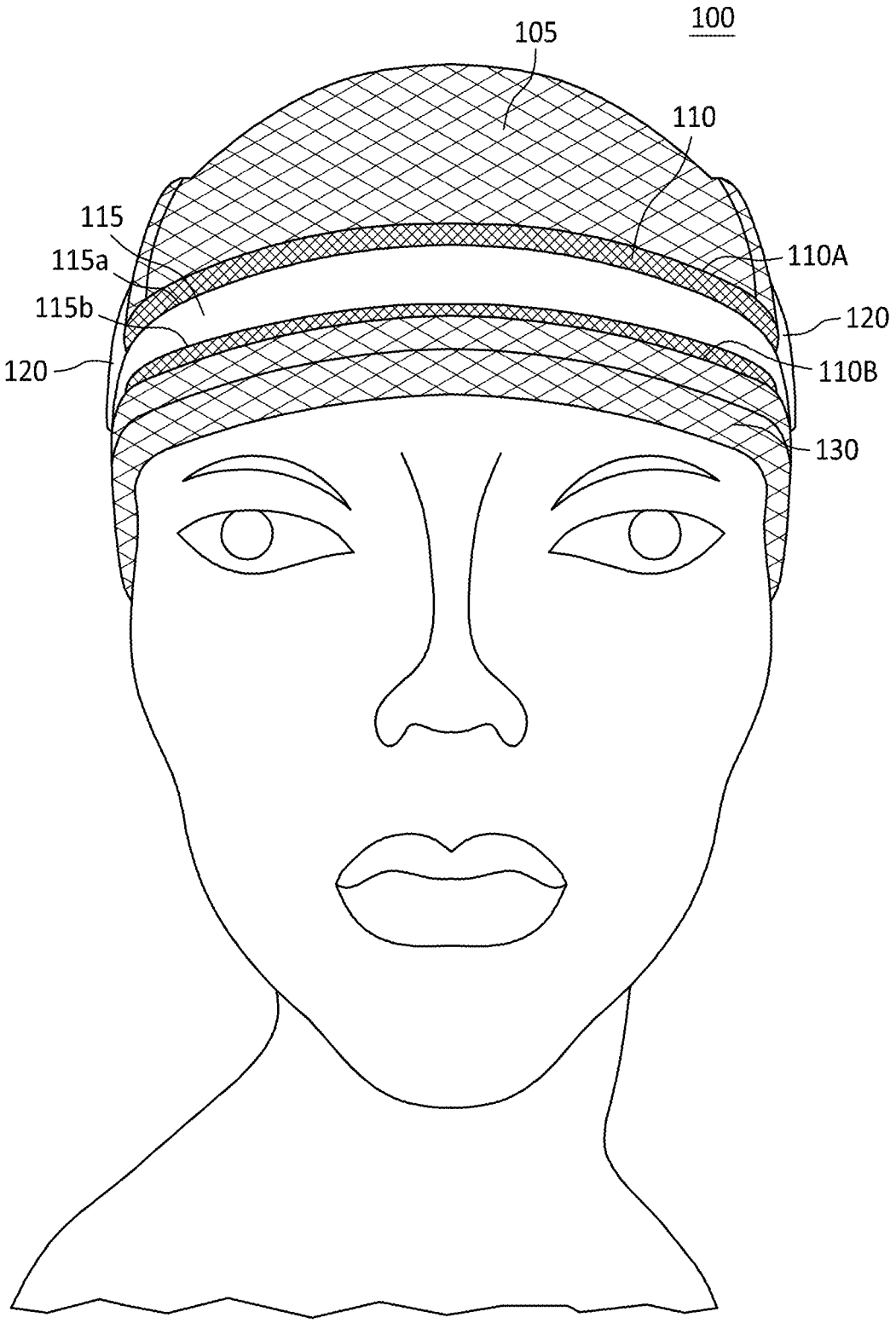
FIG. 1 illustrates a front view of a wig apparatus according to an embodiment of the present invention.

FIG. 1 illustrates a front view of a wig apparatus 100 according to an embodiment of the present invention. It is noted that the wig apparatus 100 shown in FIG. 1 is in an inside-out configuration for purposes of illustration. The wig apparatus 100 includes a mesh cap 105, an elastic band 110, a silicone strip 115, and multiple comb members 120. The wig apparatus 100 is configured such that artificial hair can be coupled to an outer surface thereof. The artificial hair can be sewn, glued, crocheted, or attached by any other suitable method, to the outer surface of the mesh cap 105. A user can therefore customize the appearance of the wig apparatus 100 by selecting various colors, textures, and lengths of artificial hair to couple to the outer surface of the wig apparatus 100.

The mesh cap 105 is configured to cover the scalp of a user. In other words, the mesh cap 105 is configured in a dome shape. The mesh cap 105 includes an inner surface and an outer surface. The mesh cap 105 is constructed of cotton, nylon, elastic, spandex, or other suitable material and combinations thereof. In certain embodiments, the mesh cap 105 includes holes in the surface thereof that are the same size throughout the entire mesh cap 105. In certain embodiments, the mesh cap 105 is constructed of a mesh that has large holes, e.g., of a size that a user could readily see through and that would allow the user to pull their natural hair through. In certain embodiments, the mesh cap is constructed of a mesh that has small holes, e.g., of a size that the user could not easily pull their natural hair through. In certain embodiments, the mesh cap 105 is constructed of a mesh that has both large holes and small holes. As further described herein, the mesh cap 105 includes a folded portion 130 that wraps around the elastic band 110.

The elastic band 110 extends around a circumference of the mesh cap 105. The elastic band 110 includes an outer elastic band surface, an inner elastic band surface, a top band edge 110A and a bottom band edge 110B. The outer elastic band surface refers to the surface of the elastic band 110 that faces away from the user when the wig apparatus 100 is worn by the user. The inner elastic band surface refers the surface of the elastic band 110 that faces towards the users when the wig apparatus 100 is worn by the user. The elastic band 110 is constructed of an elastic material, such as cotton, nylon, elastic, spandex, or other suitable material and combinations thereof. The elastic band 110 is coupled to the mesh cap 105 and extends around the circumference of the mesh cap 105. In certain embodiments, the elastic band 110 is sewn, glued, or attached by any other suitable method, to the mesh cap 105. The elastic band 110 is configured to extend around the user's head, securing the wig apparatus 100 in place. When the wig apparatus is worn by the user, the elastic band 110 extends across the user's forehead, around the user's temples, and around the user's head in a location approximately corresponding to the user's hairline.

In certain embodiments, the folded portion 130 of the mesh cap 105 wraps around at least a portion of the bottom band edge 110B of the elastic band 110 such that at least a portion of the outer elastic band surface is in contact with the inner surface of the mesh cap 105 and at least a portion of the inner elastic band surface is in contact with the inner surface of the mesh cap 105. Thus, at least a portion of the folded portion 130 is in contact with the inner elastic band surface.

In certain embodiments, the elastic band 110 is about 0.5 cm to about 10 cm thick. In certain embodiments, the elastic band 110 is about 1 cm to about 8 cm thick. In certain embodiments, the elastic band 110 is about 2 cm to about 6 cm thick. The elastic band 110 is not limited to any particular thickness and can vary according to the functional needs of the wig apparatus 100. The "thickness" refers to the distance between the points denoted by bracket "A" in FIG. 4.

In certain embodiments, the mesh cap 105 is configured to have artificial hair coupled to the outer surface of the mesh cap 105 adjacent to the outer elastic band surface and adjacent to the inner elastic band surface. The artificial hair coupled to the mesh cap 105 adjacent to the outer elastic band surface of the elastic 110 extends away from the user when the wig apparatus 100 is worn by the user. The artificial hair coupled to the mesh cap 105 adjacent to the inner elastic band surface of the elastic 110 extends towards the user when the wig apparatus 100 is worn by the user.

Figure 2:
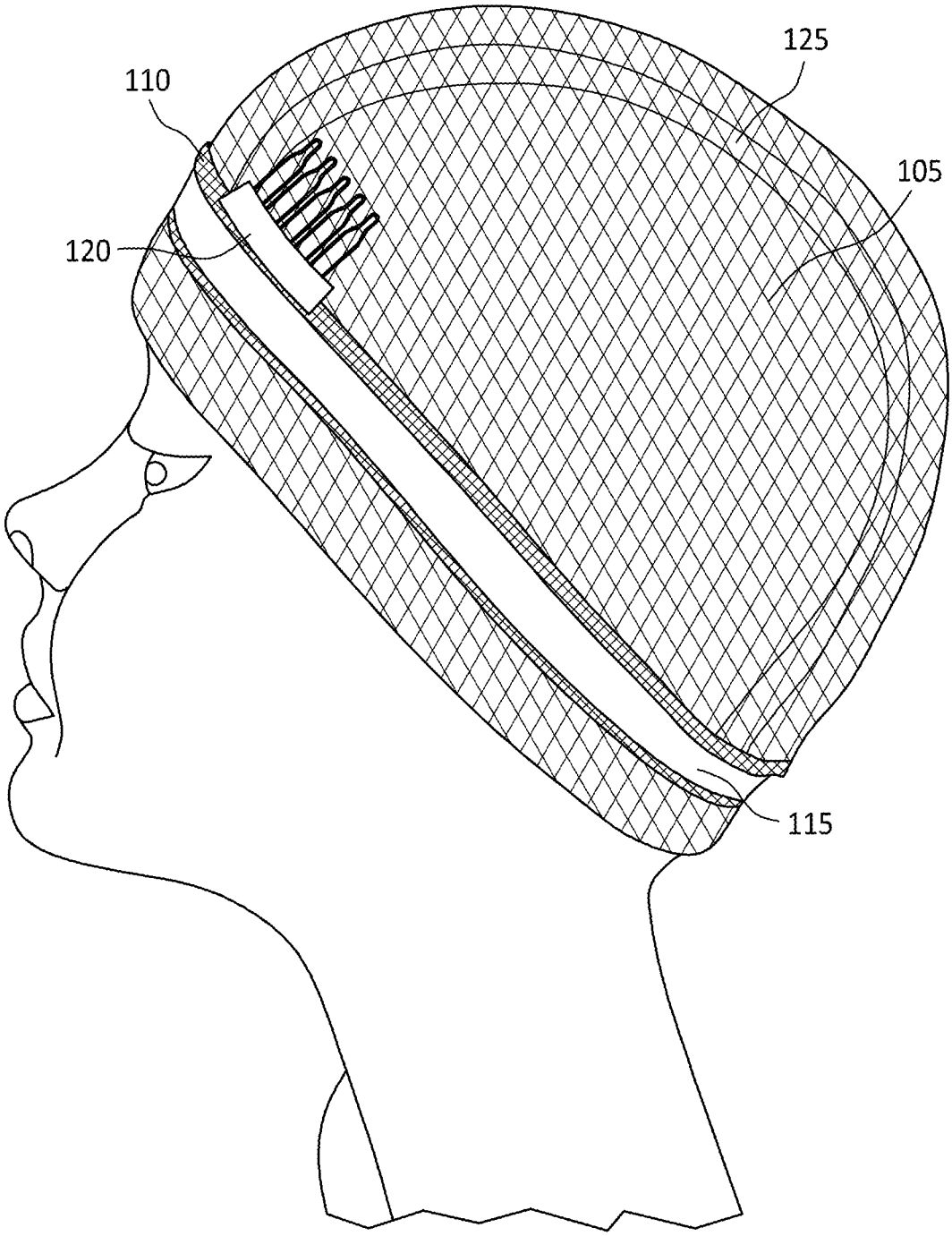
FIG. 2 illustrates a side view of the wig apparatus.
Figure 3:
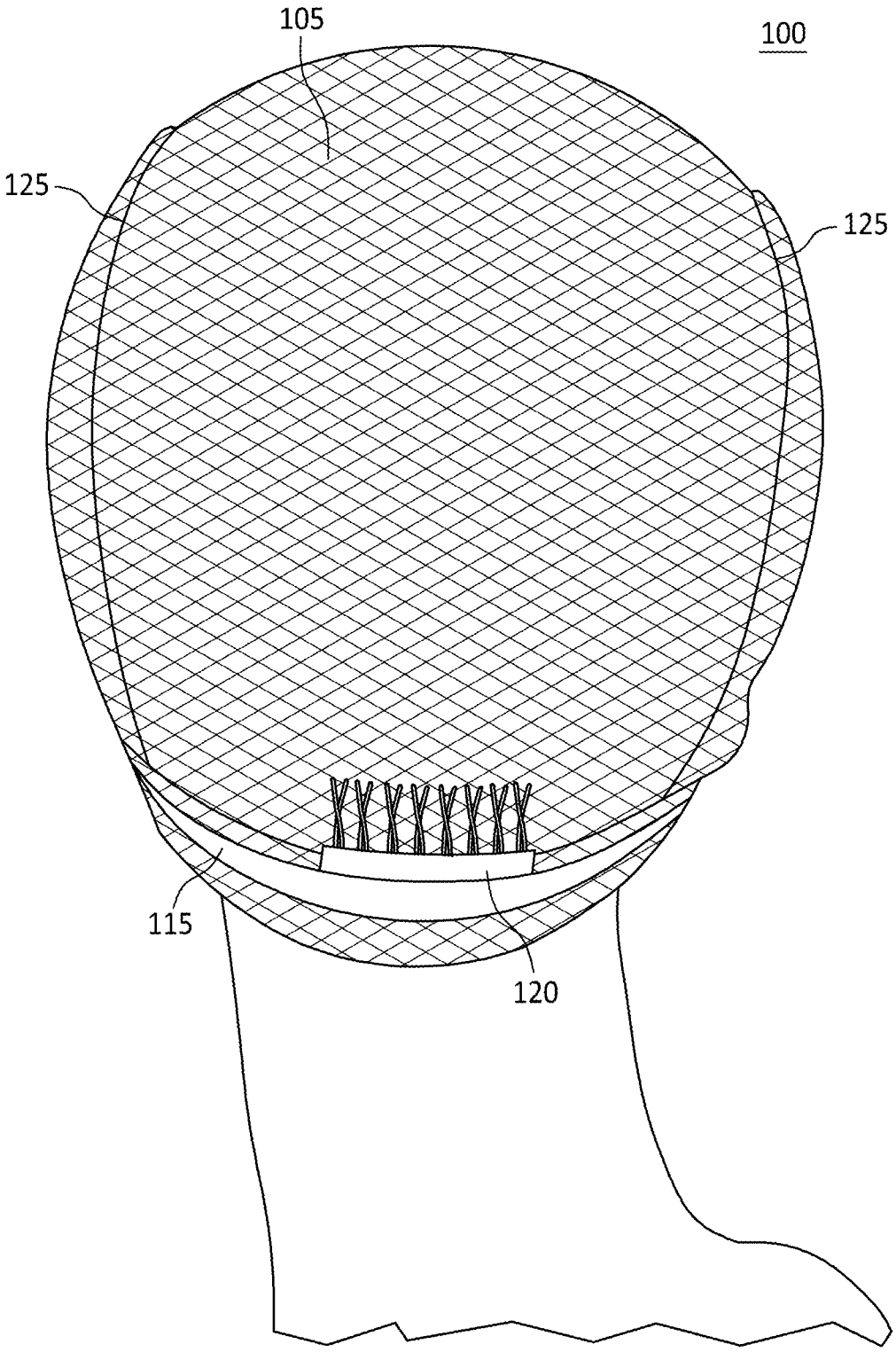
FIG. 3 illustrates a rear view of the wig apparatus.

FIG. 2 illustrates a side view of the wig apparatus 100 and FIG. 3 illustrates a rear view of the wig apparatus 100. The silicone strip 115 extends around a circumference of the mesh cap 105. The silicone strip 115 includes a top strip edge 115A and a bottom strip edge 115B. The silicone strip 115 is constructed of silicone, rubber, or other suitable material. The silicone strip 115 is configured to provide an anti-slip surface that contacts the user's natural hair or scalp when the wig apparatus 100 is worn by the user, limiting or preventing the wig apparatus 100 from slipping on the user's head. The silicone strip 115 maintains the positioning of the wig apparatus 100 on the user's head. In certain embodiments, the silicone strip 115 is coupled to the elastic band 110. In certain embodiments, the silicone strip 115 is sewn, glued, or attached by any other suitable method, to the elastic band 110.

In certain embodiments, the thickness of the silicone strip 115 is less than the thickness of the elastic band 110. In certain embodiments, the thickness of the silicone strip 115 is greater than the thickness of the elastic band 110. In certain embodiments, the thickness of the silicone strip 115 is about equal to the thickness of the elastic band 110. In certain embodiments, the thickness of the silicone strip 115 is about half of the thickness of the elastic band 110. In certain embodiments, the thickness of the silicone strip 115 is about one quarter of the thickness of the elastic band 110. In certain embodiments, the thickness of the silicone strip 115 is about three quarters of the thickness of the elastic band 110.

As illustrated in FIGS. 2 and 3, the combs 120 are disposed on the front of the inner surface of the mesh cap 105, in areas approximately corresponding to the user's temples and to the back of the user's neck, i.e., the user's nape region. The combs 120 include tines that are inserted into the user's natural hair. The combs 120 secure the wig apparatus 100 to the user's head.

As illustrated in FIGS. 2 and 3, in certain embodiments, the mesh cap 105 includes multiple seams 125. The mesh cap 105 is constructed of three separate pieces of material that are sewn together along seams 125.

Figure 4:
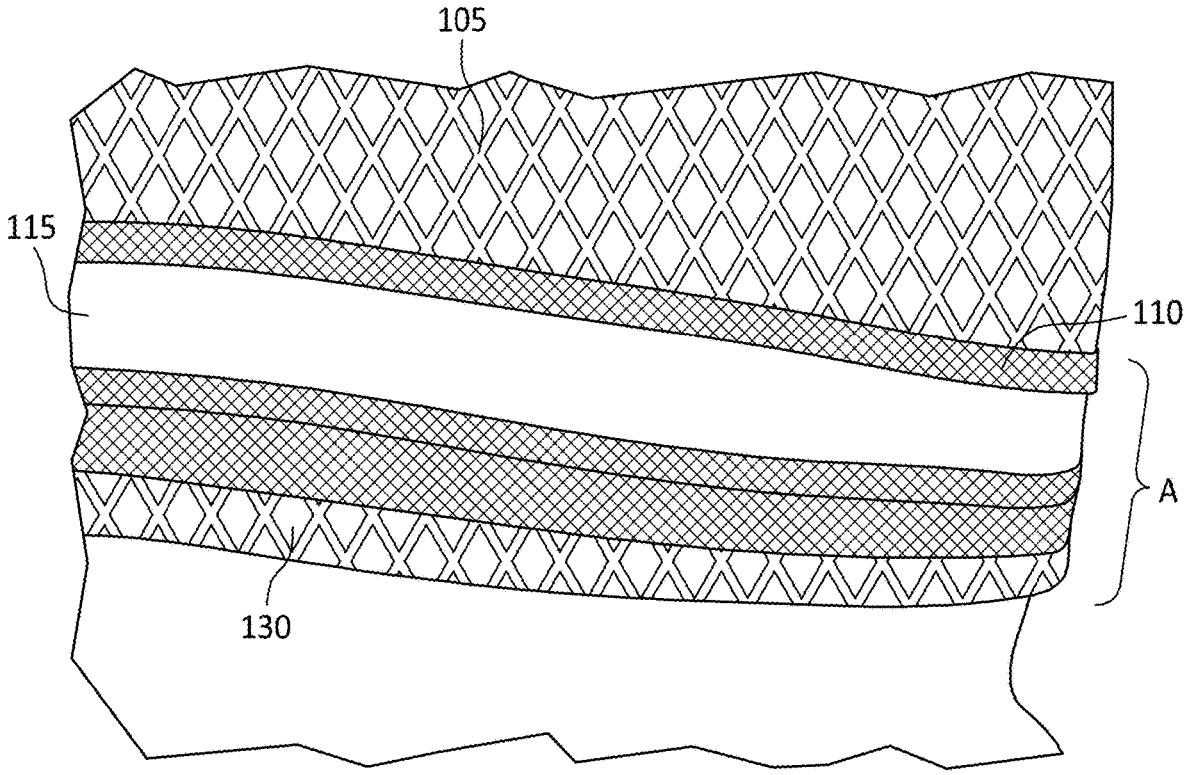
FIG. 4 illustrates an expanded side view of the wig apparatus.

FIG. 4 illustrates an expanded side view of the wig apparatus 100. As illustrated in FIG. 4, the folded portion 130 of the mesh cap 105 folds around the elastic band 110. In certain embodiments, the folded portion 130 of the mesh cap 105 extends up to the bottom edge of the silicone strip 115 and is coupled to the elastic band 110. In certain embodiments, the folded portion 130 of the mesh cap 105 extends underneath the silicone strip 115 such that at least a portion of the folded portion is disposed between the silicone strip 115 and the elastic band 110. In certain embodiments, the folded portion 130 is coupled to the elastic band 110 on one surface and is coupled to the silicone strip 115 on the opposite surface of the folded portion 130. In certain embodiments, the folded portion 130 of the mesh cap 105 extends underneath the silicone strip 115 such that at least a portion of the folded portion is disposed between the silicone strip 115 and the elastic band 110, and at least a portion of the folded portion 130 extends beyond the top edge of the silicone strip 115. In certain embodiments, the folded portion 130 of the mesh cap 105 extends underneath the silicone strip 115 such that at least a portion of the folded portion 130 is disposed between the silicone strip 115 and the elastic band 110, and at least a portion of the folded portion extends beyond the top edge of the silicone strip 115 and does not extend beyond the elastic band 110.

The folded portion 130 of the mesh cap 105 allows the user to couple artificial hair to the outer surface of the mesh cap 105 near the edge of the mesh cap 105. In other words, the folded portion 130 is configured to have artificial hair coupled to a location where the mesh cap 105 folds around the elastic band 110, which allows the user to couple artificial hair to the perimeter of the mesh cap 105, i.e., the edge of the mesh cap 105 where the folded portion 105 folds around the elastic band 110. This configuration allows the user to create a natural-appearing edge to the mesh cap 105 that cannot be achieved by only coupling artificial hair to the outer surface of the mesh cap 105.

In certain embodiments, artificial hair is coupled to the outer surface of the mesh cap 105 in an area corresponding to the outer elastic band surface and to the outer surface of the mesh cap 105 in an area corresponding to the inner elastic band surface. In certain embodiments, artificial hair is coupled to the outer surface of the mesh cap 105 in an area corresponding to the outer elastic band surface, to the perimeter of the mesh cap 105, and to the outer surface of the mesh cap 105 in an area corresponding to the inner elastic band surface. Thus, the mesh cap 105 wraps around the elastic band 110 such that the inner surface of the mesh cap 105 is contact with both the outer elastic band surface and the inner elastic band surface.

In certain embodiments, the folded portion 130 of the mesh cap 105 does not overlap the silicone strip 115. In other words, the folded portion 130 does not extend over the silicone strip 115 and does not extend underneath the silicone strip 115.

In certain embodiments, the folded portion 130 of the mesh cap 105 is disposed between the bottom strip edge 115B of the silicone strip 115 and the elastic band 110, and the folded portion 130 of the mesh cap 105 is not disposed between the top strip edge 115A of the silicone strip 115 and the elastic band 110.

In certain embodiments, the elastic band 110 includes a space between the folded portion 130 of the mesh cap 105 and the bottom strip edge 115B of the silicone strip 115. In other words, there is a space between the folded portion 130 of the mesh cap 105 and the bottom strip edge 115B of the silicone strip 115, exposing the surface of elastic band 110.

Figure 5:
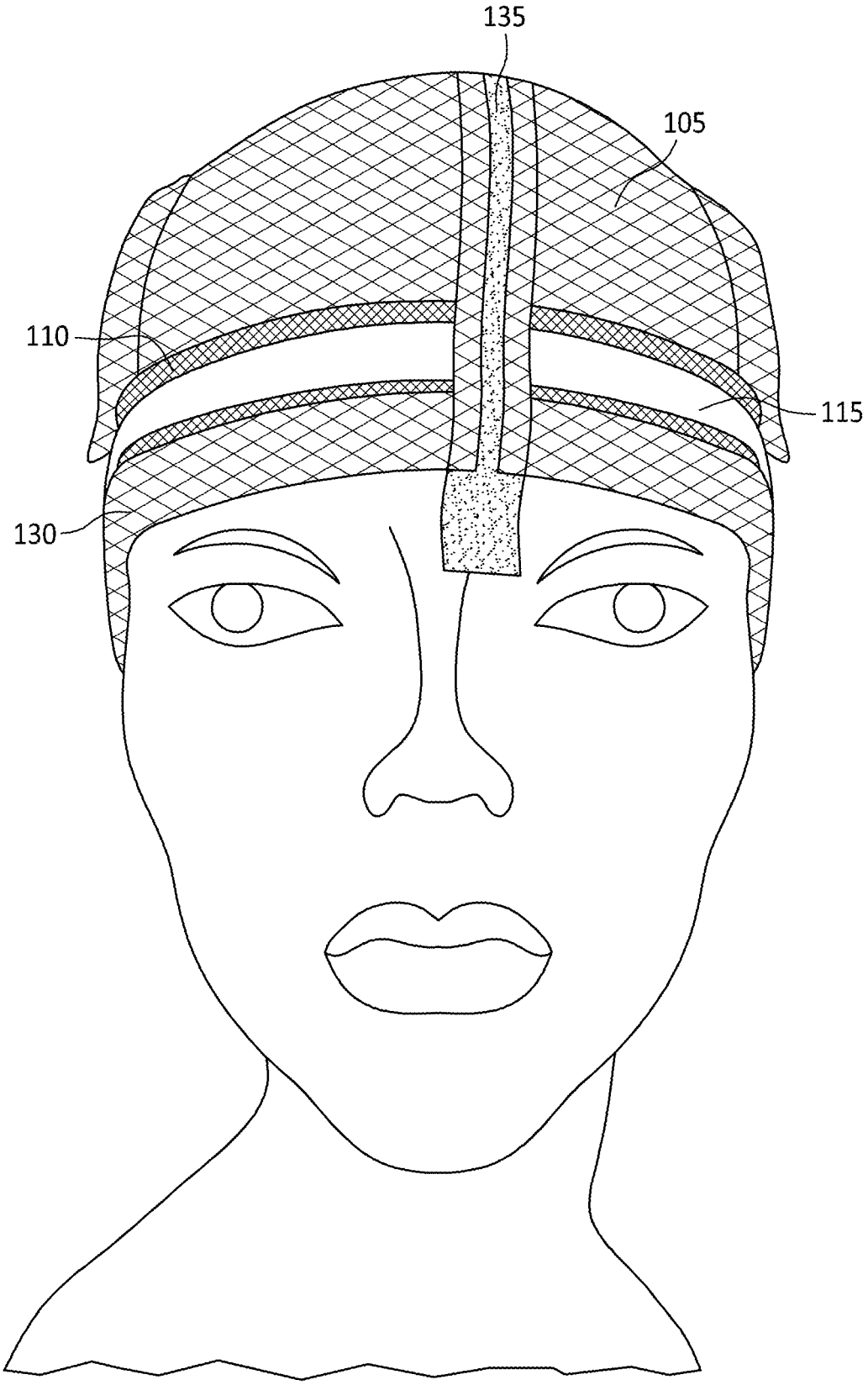
FIG. 5 illustrates an alternative embodiment of the wig apparatus including a parting region.

FIG. 5 illustrates an alternative embodiment of the wig apparatus 100 including a parting region 135. The parting region 135 includes an inner parting region surface and an outer parting region surface. The inner parting region surface refers to the surface facing towards the user when the wig apparatus 100 is worn. The outer parting region surface refers to the surface facing away from the user when the wig apparatus 100 is worn. The parting region 135 is constructed of a fine mesh material such as nylon or other suitable material. For example, the mesh of the parting region 135 is fine enough that a user cannot easily pull their natural hair through the parting region 135. The parting region 135 is intended to mimic the user's scalp and allow the artificial hair to be coupled to the outer parting region surface and be parted along the line created by the parting region 135. The mesh of the parting region 135 is sewn, glued, or attached by any other suitable method, to the mesh cap 105. In certain embodiments, artificial hair is coupled to the outer surface of the parting region 135.

In certain embodiments, the parting region 135 is about 0.5 mm to about 350 mm wide. In certain embodiments, the parting region 135 is about 5 mm to about 250 mm wide. In certain embodiments, the parting region 135 is about 10 mm to about 150 mm wide. The parting region 135 is not limited to any particular width or shape and can vary according to the desired aesthetic appearance of the wig apparatus 100.

In certain embodiments, the parting region 135 is about 2 cm to about 20 cm deep, i.e., the distance from the front edge of the parting region 135 near the user's forehead to the rear edge of the parting region 135 near the top of the user's head. In certain embodiments, the parting region 135 is about 4 cm to about 15 cm deep. In certain embodiments, the parting region 135 is about 6 cm to about 12 cm deep. The parting region 135 is not limited to any particular depth and can vary according to the desired aesthetic appearance of the wig apparatus 100.

In certain embodiments, a seam is sewn along the parting region 135 that stitches together the edges of the mesh of the parting region 135, the edges of the mesh of the mesh cap 105, the ends of silicone strip 115 and the ends of the elastic band 110.

In certain embodiments, the elastic band 110 and the silicone strip 115 do not extend around the entire circumference of the mesh cap 105. In other words, the elastic band 110 and the silicone strip 115 extend up to the parting region 135, but do not extend over the parting region 135.

Figure 6:
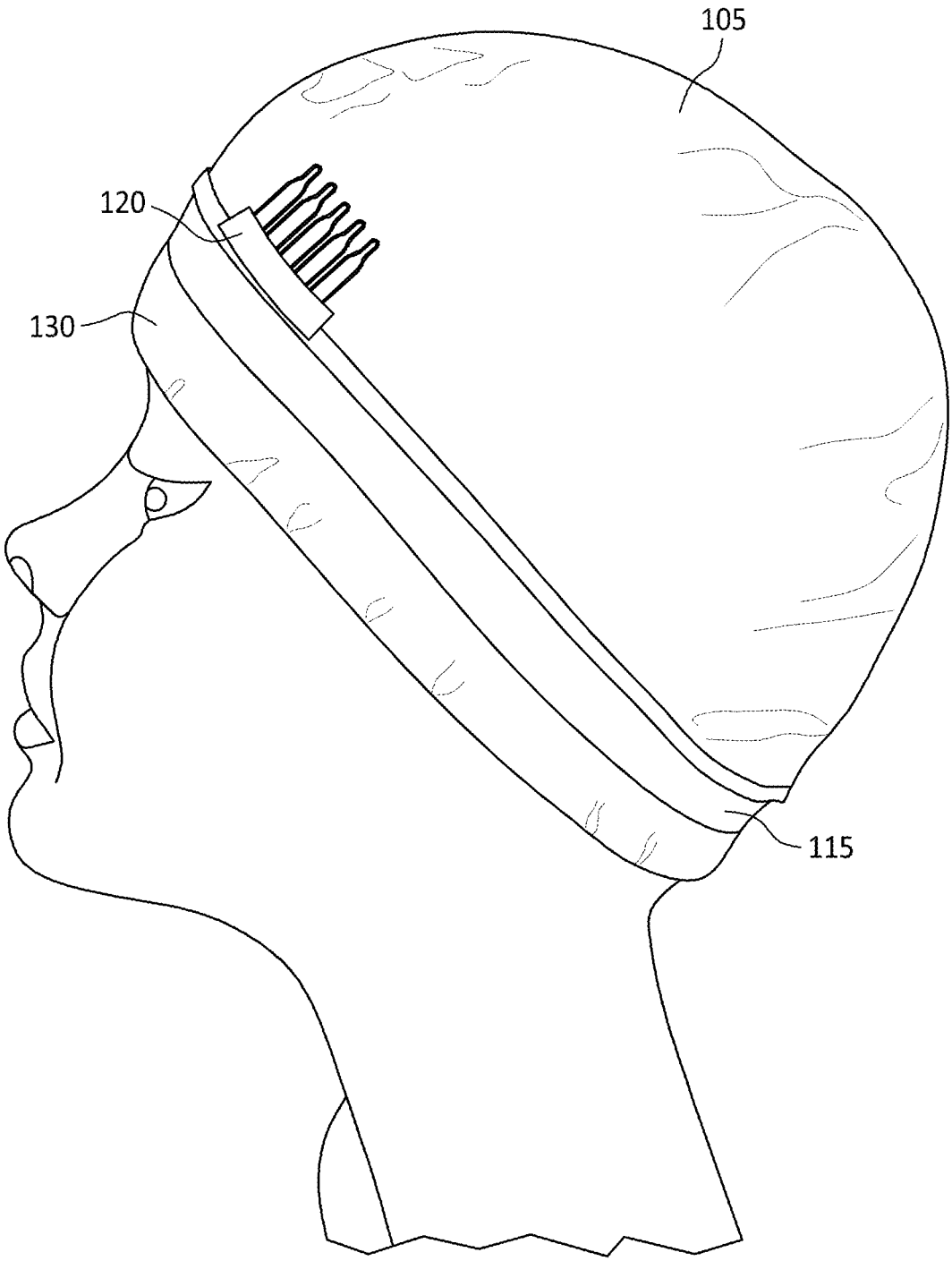
FIG. 6 illustrates an alternative embodiment of the wig apparatus in which a mesh cap is constructed of an alternative material.

FIG. 6 illustrates an alternative embodiment of the wig apparatus 100 in which the mesh cap 105 is constructed of an alternative material. In the embodiment shown in FIG. 6, the mesh cap 105 is constructed of nylon, micro, spandex and net stretch fabric, or other suitable material.

Embodiments of the invention described herein provide a wig apparatus that is configured to fit onto, and be secured tightly to, a user's head. The wig apparatus includes various components configured to securely couple the wig apparatus to the user's head, while also allowing the user to couple artificial hair to the mesh cap so that the user can customize the appearance of the wig apparatus to their own personal preference. The portion of the mesh cap that folds around the elastic band at the edge of the mesh cap allows the user to couple artificial hair to the outer surface of the wig apparatus, the perimeter of the mesh cap, as well as the inner surface of the wig apparatus.

While embodiments of the invention have been shown and described with reference to certain embodiments thereof, it will be understood by those skilled in the art that various changes in form and details may be made therein without departing from the spirit and scope of the invention and equivalents thereof.

What is claimed is:

1. A wig apparatus comprising:

artificial hair;

a mesh cap configured to cover the scalp of a user, the mesh cap comprising an inner surface, an outer surface, and a folded portion, wherein the artificial hair is coupled to at least a portion of the outer surface of the mesh cap;

an elastic band configured to extend around the user's head comprising an outer elastic band surface, an inner elastic band surface, a bottom band edge and a top band edge, wherein the elastic band is coupled to the mesh cap and extends around a circumference of the mesh cap, and wherein the folded portion of the mesh cap wraps around at least a portion of the bottom band edge of the elastic band such that at least a portion of the outer elastic band surface is in contact with the inner surface of the mesh cap and at least a portion of the inner elastic band surface is in contact with the inner surface of the mesh cap; and a silicone strip configured to extend around a circumference of the mesh cap on the inner surface of the mesh cap comprising a top strip edge and a bottom strip edge, the silicone strip coupled to at least a portion of the elastic band, wherein the folded portion of the mesh cap extends underneath the silicone strip such that at least a portion of the folded portion is disposed between the silicone strip and the inner elastic band surface of the elastic band.

2. The wig apparatus according to claim 1, wherein a thickness of the silicone strip is less than a thickness of the elastic band.

3. The wig apparatus according to claim 1, wherein a thickness of the silicone strip is about equal to a thickness of the elastic band.

4. The wig apparatus according to claim 1, wherein a thickness of the silicone strip is selected from one of about half, about one quarter and about three quarters of a thickness of the elastic band.

5. The wig apparatus according to claim 1, wherein the folded portion of the mesh cap extends underneath the silicone strip such that at least a portion of the folded portion is disposed between the silicone strip and the elastic band, and wherein at least a portion of the folded portion extends beyond the top strip edge of the silicone strip.

6. The wig apparatus according to claim 1, wherein the folded portion of the mesh cap extends underneath the silicone strip such that at least a portion of the folded portion is disposed between the silicone strip and the elastic band, and wherein at least a portion of the folded portion extends beyond the top strip edge of the silicone strip and does not extend beyond the elastic band.

7. The wig apparatus according to claim 1, wherein the mesh cap is configured to have artificial hair coupled to the outer surface of the mesh cap adjacent to the outer elastic band surface and adjacent to the inner elastic band surface.

8. The wig apparatus according to claim 1, wherein the folded portion of the mesh cap is configured to have artificial hair coupled to a location where the mesh cap folds around the elastic band.

9. The wig apparatus according to claim 1, wherein the folded portion of the mesh cap does not overlap the silicone strip.

10. The wig apparatus according to claim 1, wherein the folded portion of the mesh cap is disposed between the bottom strip edge of the silicone strip and the elastic band, and wherein the folded portion of the mesh cap is not disposed between the top strip edge of the silicone strip and the elastic band.

11. The wig apparatus according to claim 1, further comprising:

a parting region comprising an inner parting region surface and an outer parting region surface and wherein the artificial hair is coupled to the outer parting region surface;

a seam is sewn along the parting region that stitches together at least a portion of each of the parting region, the mesh cap, the silicone strip and the elastic band.

12. The wig apparatus according to claim 11, wherein the elastic band and the silicone strip extend up to the parting region and do not extend over the parting region.

13. The wig apparatus according to claim 1, wherein the artificial hair is coupled to a perimeter of the mesh cap.

14. The wig apparatus according to claim 1, wherein the artificial hair is coupled to the mesh cap adjacent to the inner elastic band surface of the elastic band and extends towards the user when the wig apparatus is worn by the user.

15. The wig apparatus according to claim 1, wherein the outer elastic band surface faces away from the user when the wig apparatus is worn by the user and the inner elastic band surface faces towards the user when the wig apparatus is worn by the user.

* * * * *